United States Patent [19]

Oya

[11] 4,041,826

[45] Aug. 16, 1977

[54] ELECTRONIC MUSICAL INSTRUMENT

[75] Inventor: Akiyoshi Oya, Hamamatsu, Japan

[73] Assignee: Nippon Gakki Seizo Kabushiki Kaisha, Japan

[21] Appl. No.: 601,945

[22] Filed: Aug. 4, 1975

[30] Foreign Application Priority Data

| | | |
|---|---|---|
| Aug. 7, 1974 | Japan | 49-90515 |
| Aug. 12, 1974 | Japan | 49-92172 |
| Aug. 14, 1974 | Japan | 49-93660 |

[51] Int. Cl.[2] ..... G10H 1/00

[52] U.S. Cl. ..... 84/1.01; 84/1.03

[58] Field of Search ..... 84/1.01, 1.03, 1.11, 84/1.13, 1.16, 1.19, 1.24, 1.26; 340/172.5

[56] References Cited

U.S. PATENT DOCUMENTS

| | | | |
|---|---|---|---|
| 3,639,913 | 2/1972 | Watson | 84/1.01 |
| 3,696,201 | 10/1972 | Arsem | 84/1.03 |
| 3,697,661 | 10/1972 | Deutsch | 84/1.11 |
| 3,746,773 | 7/1973 | Uetrecht | 84/1.01 |
| 3,828,110 | 8/1974 | Colin | 84/1.24 |
| 3,871,247 | 3/1975 | Bonham | 84/1.16 |
| 3,882,751 | 5/1975 | Tomisawa | 84/1.11 |
| 3,890,871 | 6/1975 | Oberheim | 84/1.03 |
| 3,899,951 | 8/1975 | Griffith et al. | 84/1.03 |
| 3,986,423 | 10/1976 | Ressum | 84/1.01 |
| 3,991,645 | 11/1976 | Luce et al. | 84/1.01 |

*Primary Examiner*—Robert K. Schaefer
*Assistant Examiner*—Vit W. Miska
*Attorney, Agent, or Firm*—Ladas, Parry, Von Gehr, Goldsmith & Deschamps

[57] ABSTRACT

An electronic musical instrument called a music synthesizer has channels equal in number to a maximum number of tones to be reproduced simultaneously and can produce a plurality of musical tones simultaneously. Note voltages are sampled by actuating corresponding key gate circuits and the sampled note voltages are allotted to corresponding channels in time-shared sequence. Musical tones are reproduced from the note voltages allotted to the respective channels. A key gate control signal for actuating the key gate circuit is obtained by detecting ON-OFF states of keys and generating a key code corresponding to a key which is ON, storing this key code in a key code memory having channels of the maximum number of tones to be reproduced simultaneously under certain conditions and decoding the key code produced from the key code memory. The musical instrument comprise means for producing the key gate control signal at a slower rate than the rate of scanning the keys.

A channel corresponding to the key which was released first is detected, a key gate control signal corresponding to this channel is cancelled and a key code representing a newly depressed key is stored in this channel to produce a corresponding key gate control signal whereby the channel corresponding to the key which was released first is detected.

5 Claims, 8 Drawing Figures

ELECTRONIC MUSICAL INSTRUMENT

BACKGROUND OF THE INVENTION

This invention relates to an electronic musical instrument generally called a music synthesizer which produces a musical tone in accordance with voltage corresponding to a note of a depressed key and, more particularly, to an electronic musical instrument of this type capable of producing a plurality of tones simultaneously.

The prior art music synthesizer can produce a desired musical tone by freely and subtly controlling the pitch, tone color and volume of the musical tone by means of a control voltage. The prior art music synthesizer, however, is disadvantageous in that it cannot produce a plurality of tones simultaneously.

This is because a note voltage generation circuit which produces note voltages corresponding to respective keys is incorporated in a keyboard circuit so as to produce a note voltage directly in response to actuation of a key switch. If the simultaneous reproduction of a plurality of tones is to be achieved in the prior art music synthesizer, a musical tone reproduction system including a voltage-controlled oscillator (VCO), voltage-controlled filter (VCF) and a voltage-controlled amplifier (VCA) needs to be provided for each key, which is quite unfeasible from standpoints of costs, size and utility.

SUMMARY OF THE INVENTION

It is an object of the present invention to provide an electronic musical instrument capable of producing a plurality of musical tones simultaneously and thereby achieving various musical effects with a very simple construction.

It is another object of the invention to provide an electronic musical instrument in which, instead of incorporating a note voltage generation circuit, a note voltage corresponding to each key is sampled by a key gate circuit which is electrically gate-controlled, the sampled outputs of the key gate circuit are applied to each of a plurality channel gate circuits corresponding to a plurality of tones to be reproduced simultaneously, each channel gate circuit is gate-controlled to allot the output note voltage provided from the key gate circuit to a corresponding channel in time-shared sequence, and desired musical tones are reproduced by each channel in accordance with the allotted note voltages.

It is another object of the invention to provide an electronic musical instrument in which a signal corresponding to a depressed key is produced by detecting ON-OFF states of all key switches arranged in the keyboard circuit, the note voltage is sampled by gate-controlling a key gate circuit corresponding to this signal and a corresponding channel gate circuit is gate-controlled in synchronization with this gate-controlling of the key gate circuit whereby the note voltages are allotted to the respective channels in time-shared sequences.

It is another object of the invention to provide an electronic musical instrument including a key assigner in which all key switches are sequentially scanned and the results of scanning are sequentially stored, a newly depressed key or a newly released key (the latter being hereinafter simply referred to as a "released key") is detected in accordance with the stored results of scanning and results of a new scanning, a key code representing the newly depressed key is stored in one of channels corresponding in number to a maximum number of tones to be reproduced simultaneously and a gate control signal for controlling the gate of the key gate circuit is produced in accordance with this stored key code.

It is another object of the invention to provide an electronic musical instrument including a key assigner in which key codes stored in the respective channels are read out in time-shared sequence at a high rate corresponding to the speed of scanning of the key switches, the read out key codes are once latched by each channel and thereafter are multiplexed in time-sharing at a relatively low rate in a plurality of multiplexing circuits whereby a key gate control signal corresponding to the rate of sampling of the note voltage is produced.

It is still another object of the invention to provide an electronic musical instrument including a key assigner in which if one of the depressed keys which are being played simultaneously is released, the number of keys released thereafter is counted with respect to each channel and a channel in which the count of the released keys is the largest is detected as a channel in which decay has progressed further than any other channel whereby this detected channel is utilized for reproduction of a tone corresponding to a newly depressed key.

DETAILED DESCRIPTION OF THE INVENTION

Figure 1:
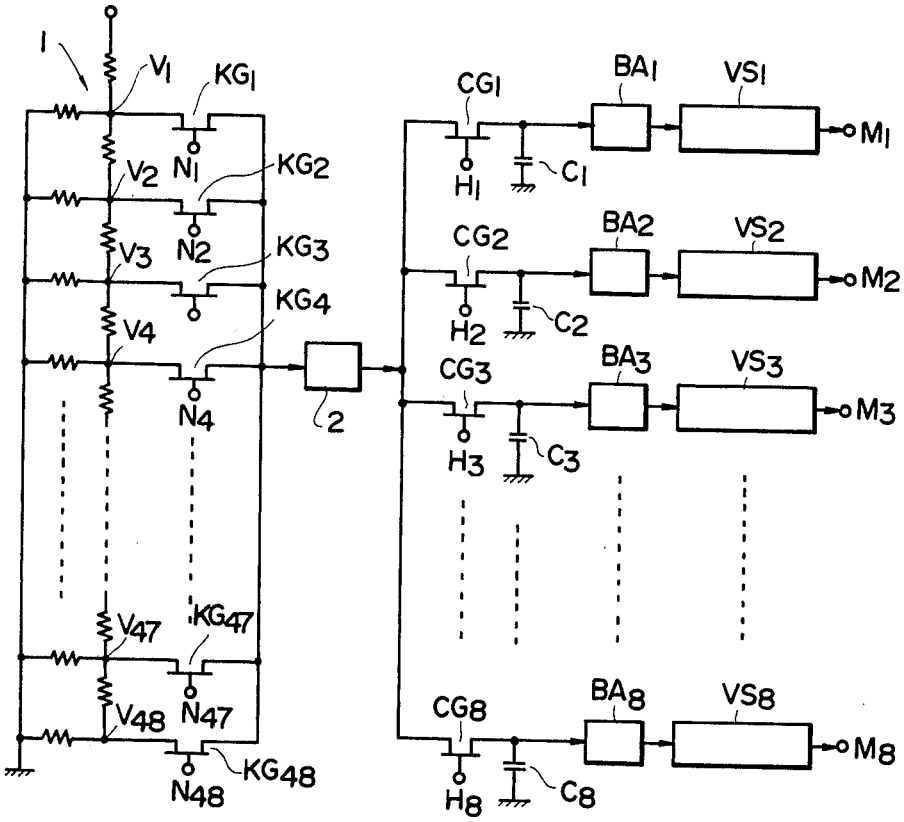
FIG. 1 is a block diagram showing one preferred embodiment of the electronic musical instrument according to the invention.

Referring to FIG. 1, a note voltage generation circuit 1 comprises a voltage dividing circuit composed of a plurality of resistors. D-c voltages corresponding to respective keys (e.g. d-c voltages proportional to the notes of the respective keys) are produced at taps $V_1$ – $V_{48}$. In this embodiment, it is assumed that the number of keys is 48 and the taps $V_1$ – $V_{48}$ correspond to the respective keys. The input terminals of key gate circuits $KG_1$ – $KG_{48}$ are respectively connected to the corresponding taps $V_1$ – $V_{48}$. Conduction and non-conduction of the note voltages from the taps $V_1$ – $V_{48}$ are controlled by application and non-application of key gate control signals $N_1$ – $N_{48}$ to the key gate circuits $KG_1$ – $KG_{48}$. The output terminals of the key gate circuits $KG_1$ – $KG_{48}$ are connected in common connection and to the input terminal of a buffer amplifier 2 of high-input and low-output impedances. The key gate circuits $KG_1$ – $KG_{48}$ consist of field-effect transistors functioning as electronic switches. One of the key gate control signals $N_1$ – $N_{48}$ corresponding to a tone to be reproduced (hereinafter representatively denoted by N) is applied to the gate of a corresponding one of these transistors.

Only one key gate control signal N at a time is applied to one of the key gate circuit $KG_1$ – $KG_{48}$ (hereinafter representatively denoted by KG). As the key gate circuit KG is brought into conduction upon application of the key gate control signal N, only one note voltage (hereinafter designated by V) is sampled through the key gate circuit KG. This key gate control signal N is generated in a time-sharing manner in response to depression of a key, as will be described in detail later.

The input terminals of channel gate circuits $CG_1$ – $CG_8$ are connected in common connected to the output of the buffer amplifier 2. Upon application of one of channel gate control signals $H_1$ – $H_8$ (hereinafer representatively designated by H) to a corresponding one of these channel gate circuits $CG_1$ – $CG_8$, this channel gate circuit (hereinafter representatively designated by CG) is brought into conduction to pass the output of the buffer amplifier 2. The channel gate circuits $CG_1$ – $CG_8$ are provided in correspondence to channels of a maximum number of tones to be reproduced simultaneously (i.e. 8 in the present embodiment).

Condensers $C_1$ – $C_8$ are respectively connected to the outputs of corresponding channel gate circuits $CG_1$ – $CG_8$ to maintain the sampled note voltage. The channel gate control signal H is applied to the channel gate circuit CG during a predetermined period of time which is sufficient for charging a corresponding one of the condensers $C_1$ – $C_8$ (hereinafter representatively designated by C) with the sampled note voltage. Accordingly, the channel gate control signals $H_1$ – $H_8$ are pulse signals having a pulse width equivalent to this predetermined period of time.

The channel gate control signals $H_1$ – $H_8$ are sequentially applied to the corresponding channel gate circuits $CG_1$ – $CG_8$ thereby enabling the channel gate circuits $CG_1$ – $CG_8$ in time-shared sequence. In accordance with this time-shared control, the condensers $C_1$ – $C_8$ are sequentially charged with different sampled note voltages and maintain these different note voltages therein. The above described key gate control signal N is applied in synchronization with the channel gate control signal H. When, for example, the channel gate control signal $H_1$ is applied to the channel gate circuit $CG_1$, the sole key gate control signal N is applied to the corresponding key gate circuit KG with a result that the note voltage is sampled from the corresponding tap and is supplied to the condenser $C_1$ for charging it. If there is no depressed key in the keyboard, no key gate control signal N is generated and, accordingly, no note voltage is sampled.

Figure 2:
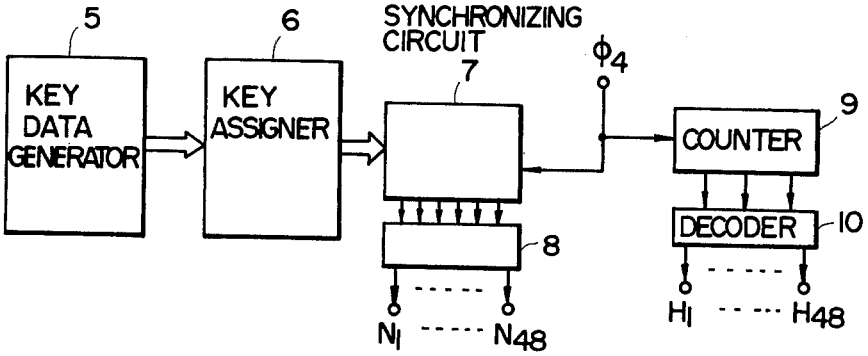
FIG. 2 is a block diagram schematically showing a construction for producing key gate control signals and channel gate control signals.

The voltages of the condensers $C_1$ – $C_8$ are applied to musical tone generation systems $VS_1$ through $VS_8$ via buffer amplifiers $BA_1$ through $BA_8$. Each of the musical tone generation systems $VS_1$ through $VS_8$ comprises a voltage-controlled oscillator (VCO), a voltage-controlled filter (VCF), a voltage-controlled amplifier (VCA) and a control voltage waveshape generator and produces a musical tone signal corresponding to the note voltage maintained in the condenser $C_1$ –$C_8$. These musical tone generation systems $VS_1$ through $VS_8$ are of a construction which is well-known in the prior art music synthesizer. In the above described manner, musical tone signals $M_1$ – $M_8$ are produced in the systems $VS_1$ through $VS_8$. The musical tone signals of the respective channels are synthesized by suitable known means and reproduced simultaneously. FIG. 2 is a block diagram schematically showing a construction for generating the key gate control signals $N_1$ – $N_{48}$ and the channel gate control signals $H_1$ – $H_8$. A key data generator 5 has a plurality of key switches each being interlocked with one of the keys in the keyboard and functions to detect ON-OFF states of the respective key switches and provide a key assigner 6 with information of a key switch which is ON. The key assigner 6 in turn generates a binary code signal in accordance with the information of the key switch which is ON thereby producing such binary code signal for each of the eight channels in the time-shared sequence.

The time-shared binary code signals for the respective channels are sequentially supplied to a synchronizing circuit 7. The synchronizing circuit 7 is provided for sequentially delivering the code signals of the respective channels to a decoder 8 in synchronization with channel clock $\phi_4$. The code signal is composed of 6-bit binary data which is sufficient for representing each of the 48 keys.

The decoder 8 produces a single output corresponding to contents of each code signal and each output of the decoder 8 constitutes the key gate control signal N. Thus, the key gate control signals N corresponding to the respective channels are generated in time-shared sequence in synchronization with the channel clock $\phi_4$. If there is no depressed key in the keyboard, no code signal is generated so that no corresponding key gate control signal N is generated.

A channel counter 9 successively counts the channel clock $\phi_4$ to produce 3-bit code outputs corresponding to the eight channels. Accordingly, a decoder 10 provides outputs $H_1$ – $H_8$ on its eight output lines in synchronization with the channel clock $\phi_4$. These outputs which are cyclically produced in time-shared sequence constitute the channel gate control signals $H_1$ – $H_8$. Accordingly, the key gate control signal N and the channel gate control signal H are always produced in synchronization with each other.

In determining the period of the channel clock $\phi_4$, operation time of the various analog circuits for sampling shown in FIG. 1, particularly the charging time for the note voltage holding condensers $C_1$ – $C_8$, must be taken into consideration. For this reason, the rate of the clock $\phi_4$ needs to be much slower than a high rate clock generally used in various digital systems.

If, accordingly, ON-OFF states of the respective key switches are detected in the key data generator 5 by a high speed scanning by using a high rate clock and the time-shared code signals are provided from the key assigner 6 at the same clock rate, the synchronizing circuit 7 must be constructed in such a manner that the time-shared code signal will be converted into a low rate signal corresponding to the channel clock $\phi_4$ before it is delivered from the circuit 7. If, on the other hand, the time-shared code signals are provided from the key assigner 6 at a low rate corresponding to the channel $\phi_4$ the synchronizing circuit 7 may simply be constructed of a conventional device such, for example, as a shift register so as to sequentially shift the code signals of the respective channels in response to the clock $\phi_4$.

Figure 3:
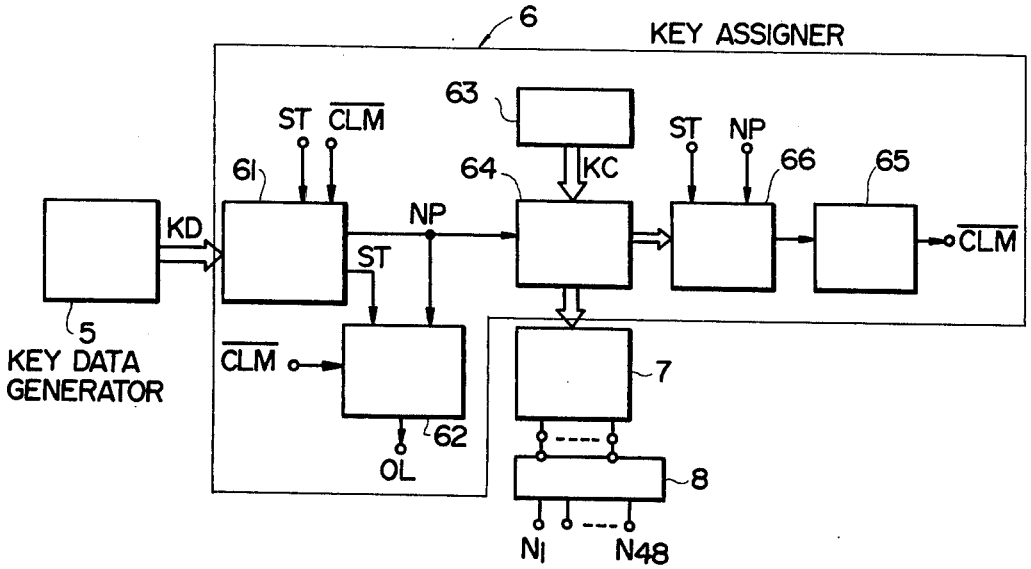
FIG. 3 is a block diagram showing more in detail the circuit shown in FIG. 2.

FIG. 3 is a block diagram showing one actual example of the key assigner 6 shown in FIG. 2. In FIG. 3, the key data generator 5 sequentially scans and detects ON-OFF states of the respective key switches of the keyboard circuit (not shown) and sequentially produces key data KD which represents a key switch which is ON by a pulse in a particular time slot in one scanning period. The key data KD is stored in a depressed and released key detector 61. This detector 61 produces a new press signal NP which represents new depression of a key in response to an inverted claim signal CLM, an old signal OL, both to be described later, and the key data KD, on conditions that (1) no key has been depressed in any one of the channels corresponding in number to the maximum number of tones to be reproduced simultaneously and (2) the key of this channel has been released before any other depressed keys (i.e. decay in this channel has most advanced). This detector 61 produces also a stop signal which represents new release of a depressed key in response to newly supplied key data KD and the key data already stored in the detector 61.

A key code generator 63 sequentially generates 6-bit binary key codes KC each corresponding to one of the keys in synchronization with the above described scanning. A key code memory 64 has channels corresponding in number to the maximum number of tones to be reproduced simultaneously each channel being capable of separately storing one of the key codes. When the new press signal NP is applied to the key code memory 64, the key code KC supplied from the key code generator 63 is stored in a channel which satisfies both of the above described conditions.

A key depression memory 65 stores information as to whether a key is depressed in each channel, producing inverted claim signal CLM in a channel in which no key is depressed. A key depression memory control unit 66 causes the memory 65 to store information representing depression of a key in a corresponding channel upon receipt of the new press signal NP, and causes the memory 65 to clear a channel in which a key code corresponding to a stop signal ST is stored upon receipt of such stop signal ST.

An old signal generator 62 substantially counts lapse of time after release of a key in each channel and produces an old signal OL in a channel in which the key was released before any other channel. More specifically, the number of the stop signals ST produced after generation of the inverted claim signal CLM in this channel is counted and the counted value is reset by the new press signal NP. Thus, the number of keys released after release of a key in a particular channel is counted for each individual channel in which the key has been released and the old signal is produced in a channel in which the count is greatest, i.e. the key was released before any other channels.

The synchronizing circuit 7 receives the key codes which have stored in the respective channels of the key code memory 64 and read therefrom in time-shared sequence, temporarily holds the contents of these key codes by each channel and thereafter multiplexes them in time-sharing at a lower rate. The key codes delivered at the lower time-sharing rate are sequentially decoded and key gate control signals N1, N2 -----corresponding to the respective key codes are sequentially provided at the low time-sharing rate suitable for use as a rate for sampling the note voltages.

Figure 4:
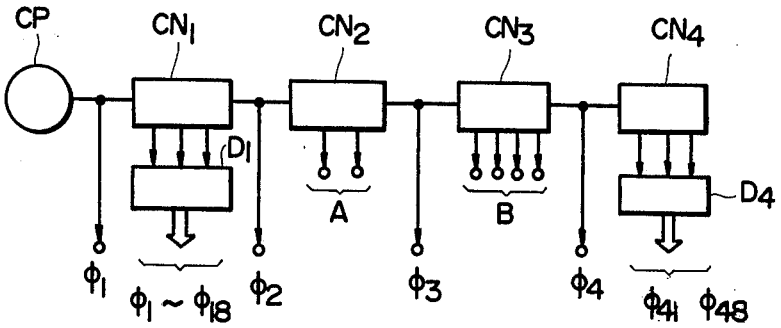
FIG. 4 is a diagram showing a construction for generating various clock pulses used in the electronic musical instrument according to the invention.

For achieving the purpose of reproducing plurality of musical tones simultaneously, the key assigner 6 has a construction based on dynamic logic so that the counters, logical circuits and memories provided therein are used in a time-sharing manner. Accordingly, time relations between clock pulses controlling the operations of these counters etc. are very important factors for the operation of the key assigner 6. The clock pulses used in the inventive device will now be described with reference to FIGS. 4 and 5.

Figure 5:
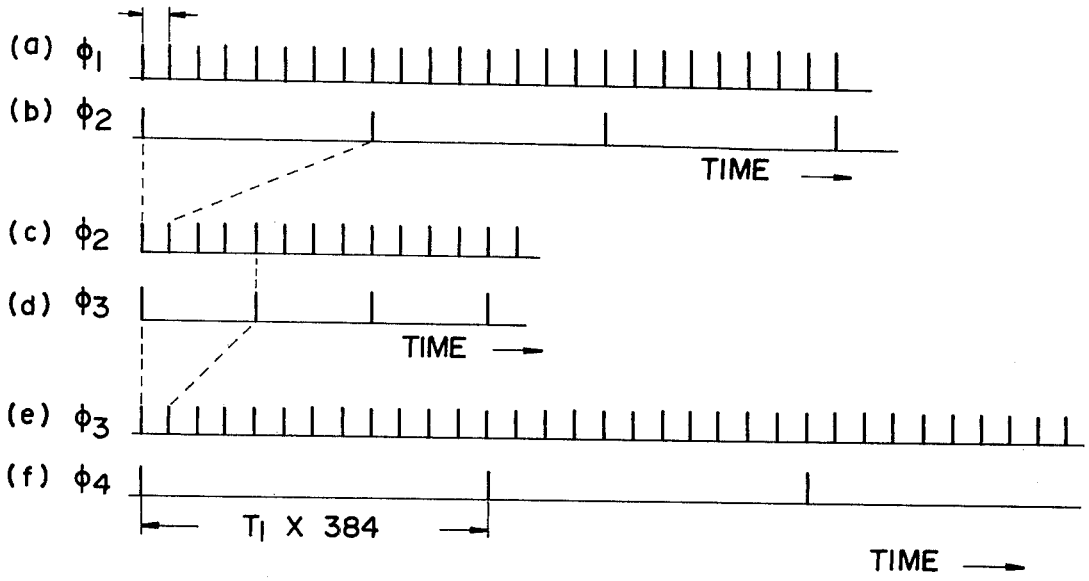
FIGS. 5 (a) through 5 (f) are timing charts showing time relations between the clock pulses.

A high channel clock $\phi_1$ is produced by a master clock oscillator CP as shown in FIG. 5 (*a*). The pulse interval of the high channel clock $\phi_1$ hereinafter is referred to as "high channel time". The clock $\phi_1$ is frequency divided by an octanary counter $CN_1$ to provide a high key clock $\phi_2$ as shown in FIG. 5 (*b*). The pulse interval of the high key clock $\phi_2$ hereinafter is referred to as "high key time". Eight high channel time is equal to one high key time. The counted outputs of the counter $CN_1$ are decoded by a decoder $D_1$ and decoded outputs obtained every high channel time during one high key time are called first-eighth high channel synchronizing clocks $\phi_{11} - \phi_{18}$ respectively having a pulse width of one high channel time and a pulse interval of one high key time.

FIG. 5 (*c*) shows the high key clock $\phi_2$ in a diminished time scale and FIG. 5 (*d*) shows a note clock $\phi_3$ which is produced by frequency dividing the high key clock $\phi_2$ by a counter $CN_2$ in the time scale as in the FIG. 5 (*c*). FIG. 5 (*e*) shows the note clock $\phi_3$ in a diminished time scale and FIG. 5 (*f*) shows a low channel $\phi_4$ which is a frequency divided output of a duodecimal counter $CN_3$ in the same time scale as in FIG. 5 (*e*). The pulse interval of this clock $\phi_4$ is hereinafter referred to as "low channel time", one low channel time is equal to 384 high channel times. An octanary counter $CN_4$ counts the low channel clock $\phi_4$ and the outputs of the counter $CN_4$ are decoded by a decoder $D_4$. Eight low channel times constitute one low key time. The decoded outputs obtained every low channel time during one low key time are called a first low channel synchronizing clock $\phi_{41}$ ----- an eight low channel synchronizing clock $\phi_{48}$. These clocks $\phi_{41} - \phi_{48}$ respectively have a pulse width of one low channel time and a pulse interval of one low key time.

Figure 6:
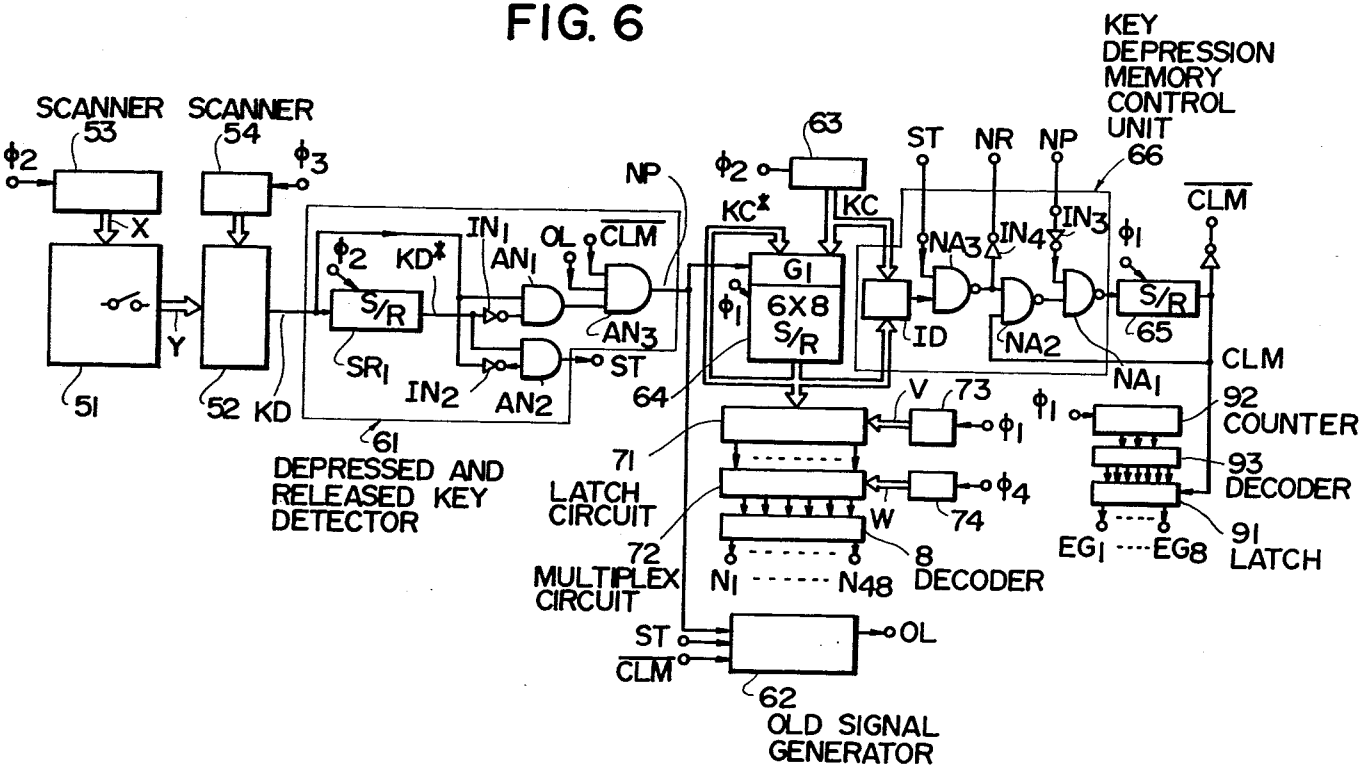
FIG. 6 is a block diagram showing the circuit shown in FIG. 3 in detail.

FIG. 6 shows the construction of the electronic musical instrument shown in FIG. 3 more in detail. Operation of the electronic musical instrument according to the invention will be described with reference to FIG. 6.

In FIG. 6, a keyboard circuit 51, multiplex circuit 52 and scanners 53, 54 constitute the key data generator 5. The keyboard circuit 51 consists of a key switch matrix having 4 input lines, 12 output lines and 48 key switches disposed at intersections of these input and output lines. These key switches are sequentially scanned at a scanning rate equivalent to the high key clock $\phi_2$. More specifically, input line scanner 53 comprising a counter and a decoder sequentially scans the four input lines X while the output line scanner 54 similarly comprising a counter and a decoder sequentially scans the twelve output lines Y in the multiplex circuit 52 by the note clock $\phi_3$ which has a pulse period for times as long as that of the clock $\phi_2$. Accordingly, information as to ON-OFF states of the respective key switches is sequentially provided in a time-shared multiplexed form from the output side of the multiplex circuit 52 at a rate of the clock $\phi_2$. A pulse (signal 1) is produced in a time slot corresponding to a key switch which is ON, whereas no pulse is produced (signal 0) in a time slot corresponding to a key switch which is OFF. This information constitutes the key data KD. One cycle of scanning requires 48 high key times. The key data KD is applied to a shift register $SR_1$ of 48 stages wherein the key data KD is sequentially shifted by the high key clock $\phi_2$. Each stage of this shift register $SR_1$ corresponds to one of the key switches whereby a result of scanning of all the key switches (all key data KD) is always held in the shift register $SR_1$ temporarily. Accordingly, the input key data KD is delayed by 48 high key times and thereafter is provided from the output of the shift register $SR_1$. It will be noted that new key data KD concerning a certain key switch is provided from the multiplex circuit 52 in synchronization with outputting from the shift register $SR_1$ of delayed key data KD* concerning the same key switch. The new key data KD and the delayed data KD* which represents a result of preceding scanning therefore are produced simultaneously. The delayed key data KD* is applied to one input terminal of an AND circuit $AN_1$ through an inverter $IN_1$. The AND circuit $AN_1$ receives at the other input terminal the new key data KD. The new key data KD is also applied to one input terminal of an AND circuit $AN_2$ through an inverter $IN_2$. The delayed key data KD* is applied to the other input terminal of the AND circuit $AN_2$. When the key data KD provided from the multiplex circuit 52 becomes 0 upon release of a depressed key, the AND circuit $AN_2$ is enabled by a signal 1 of the delayed key data KD* to produce a signal 1. This signal 1 which continues during one high key time constitutes the stop signal ST representing release of the key. On the other hand, if a key is newly depressed and the key data KD thereby becomes 1, the AND circuit $AN_1$ is enabled by an output signal 1 of the inverter $IN_1$ to produce a signal 1 during one high key time. The output of the AND circuit $AN_1$ is applied to an AND circuit $AN_3$. The AND circuit $AN_3$ is enabled and gates out a signal 1 when it further receives at the other input terminal thereof the inverter claim signal CLM and the old signal OL. The inverted claim signal CLM is produced in a time slot corresponding to a channel in which no key is depressed among the eight channels allotted to the tones which can be reproduced simultaneously. The inverted claim signal CLM has a pulse width of one high channel time. The old signal OL is produced in a time slot corresponding to a channel among these eight channels in which decay has most advanced (i.e. the key was released before any other channels). The old signal OL has a pulse width of one high channel time. Accordingly, if a certain key is newly depressed, a signal 1 having a pulse width of one high channel time is produced from the AND circuit $AN_3$ and in the time slot corresponding to the channel in which decay has most advanced. This signal constitutes the new press signal NP representing the fact that the key has been newly depressed.

This new press signal NP is applied to a gate circuit $G_1$ and the old signal generator 62. The old signal generator 62 substantially counts lapse of time and produces the old signal OL in a time slot corresponding to the channel in which the key was released before any other channels. For this purpose, the lapse of time may be counted by suitable means. For example, the lapse of time may be actually counted by each channel. Alternatively, the number of keys released after release of a key in a particular channel is counted with respect to each individual channel in which a key has been released and the channel in which the key was released before any other channels is detected by comparing results of counting of such released keys. This latter method will be further described later with reference to FIG. 8.

The key code generator 63 consists of a 48 modulo counter which sequentially counts the high key clock $\phi_2$ and produces 48 different 6-bit key codes KC corresponding to the respective keys. This key code generator 63 is of substantially the same construction as the above described scanners 53 and 54 and the outputs of the key code generator 63 are produced in complete synchronization with the outputs of the scanners 53 and 54. Accordingly, the key data KD (KD*) and the key code KC are always produced in synchronization with each other, and the key code KC produced when the new press signal NP is generated corresponds to the newly depressed key. The gate circuit $G_1$ selects a key code KC corresponding to the new press signal NP and applies it to an 8-word (1 word consisting of 6 bits) shift register 64. The key code KC applied to the shift register 64 is sequentially shifted by the high channel clock $\phi_1$ and a delayed key code KC* which is delayed by one high key time is provided at the output of the shift register 64. This delayed key code KC* is fed back to the gate circuit $G_1$ and, when no new press signal NP is present, is applied to the shift register 64 again. Thus the shift register 64 always holds the respective key codes KC for the eight channels and outputs them in time-shared sequence in accordance with the high channel clock $\phi_1$.

The key codes in the respective channels which are sequentially provided at a high rate by the high channel clock $\phi_1$ are supplied to a latch circuit 71. In the latch circuit 71, the respective key codes are sequentially latched by the clock $\phi_1$. A channel synchronize clock generator 73 comprising an octanary counter and a decoder sequentially counts the clock $\phi_1$ and thereupon sequentially provides a signal 1 on output lines V corresponding to the first through the eight channels in one high key time for causing each key code of a corresponding channel to be latched in the latch circuit 71. The latch circuit 71 temporarily holds the time-shared data and thereafter supplies 6-bit data on six output lines a ranging from the least significant bit to the most significant bit to the multiplex circuit 72 by each channel. The multiplex circuit 72 is provided for multiplexing the key codes of the respective channels in time-sharing with the low rate clock $\phi_4$. More specifically, the low channel clock generator 74 sequentially counts the low channel clock $\phi_4$ and sequentially provides a signal 1 on output lines W corresponding to the respective channels every low channel time for causing the 6-bit key codes of the respective channels to be sequentially selected from the latch circuit 71. The key codes of the respective channels are sequentially applied to a decoder 80 every low channel time. The decoder 80 produces in time-shared sequence key gate control signals $N_1 - N_{48}$ for eight channels each having one low channel time in accordance with contents of the key codes.

On the other hand, the new press signal NP is applied through an inverter $IN_3$ to an NAND circuit $NA_1$ which thereupon provides an 8-bit shift register 65 with a signal 1. This application of the signal 1 to the shift register 65 is synchronized with writing of the key codes KC in the shift register 64. The signal 1 is shifted in the shift register 65 in response to the high channel clock $\phi_1$ and delivered out of the shift register 65 one high key time later. This output signal 1 is a claim signal CLM which represents that the key is depressed in the particular channel. This claim signal CLM is applied to a NAND circuit $NA_2$. The NAND circuit $NA_2$ also receives an output signal 1 of a NAND circuit $NA_3$.

The NAND circuit $NA_2$ therefore produces an output signal 0. Since the output of inverter $IN_3$ has already become 1. a signal 1 is fed back to the particular channel of the shift register 65. Thus the signal 1. i.e. the claim signal CLM, is held in the time slot for the particular channel during depression of the key. Accordingly, the shift register 65 produces in a time sharing manner information as to whether a key is depressed or not with respect to all of the channels.

When the key has been released, the stop signal ST is generated. At this time, the output of the key code generator 63 is the key code KC corresponding to the released key during one high key time. In this one high key time, the key code KC* of the released key is produced from the shift register 64 in a time slot of any one channel. A comparator ID compares contents of the key code KC with contents of the delayed key code KC* and, when they coincide with each other, provides a signal 1 to the NAND circuit $NA_3$. The NAND circuit $NA_3$ also receives the stop signal ST, so that it produces a signal 0 when the key has been released. This causes the NAND circuit $NA_2$ to produce a signal 1 and the NAND circuit $NA_1$ to produce a signal 0. Accordingly, contents of the shift register 65 corresponding to the channel in which the key has been released become signal 0 and the inverted claim signal CLM representing the release of the key is generated. The output signal 0 of the NAND circuit $NA_3$ is inverted to a signal 1 by an inverter $IN_4$. This signal 1 constitutes a new release signal NR representing the release of the key. This new release signal NR is used in the musical tone generation systems $VS_1$ through $VS_8$. The output of the shift register 65 is also applied to a latch circuit 91 as data input thereof. An octanary counter 92 sequentially counts the clock $\phi_1$ and a decoder 93 sequentially produces an output 1 for each of the first to eight channels. The counter 92 and the decoder 93 are of the same construction as the above identified channel synchronize clock generator 73 so that the clock generator 73 can be used as the counter 92 and the decoder 93. The outputs of the shift register 65 provided in time-shared sequence are sequentially latched and held in the latch circuit 91 by each channel by the output of the decoder 93. The latch circuit 91 accordingly produces static envelope control signal for each channel $EG_1 - EG_8$ which respectively represent that a key in a particular channel is depressed. If the claim signal CLM which is produced in time-shared sequence is a signal 1, the envelope signal for the particular channel maintains a signal 1. When the signal CLM becomes 0, the envelope control signal becomes 0. These envelope control signals $EG_1 - EG_8$ are applied to corresponding ones of the musical tone generation systems $VS_1$ to $VS_8$ shown in FIG. 1 and utilized as signals indicating the depression of the keys. Envelope control voltages such as attack and decay are formed in accordance with these envelope control signals $EG_1 - EG_8$ whereby start and cease of musical tones are actually controlled. It should be noted that the voltages held in the condensers $C_1 - C_8$ in FIG. 1 are used for determining tone source frequencies and not for controlling the start and cease of the musical tones.

Figure 7:
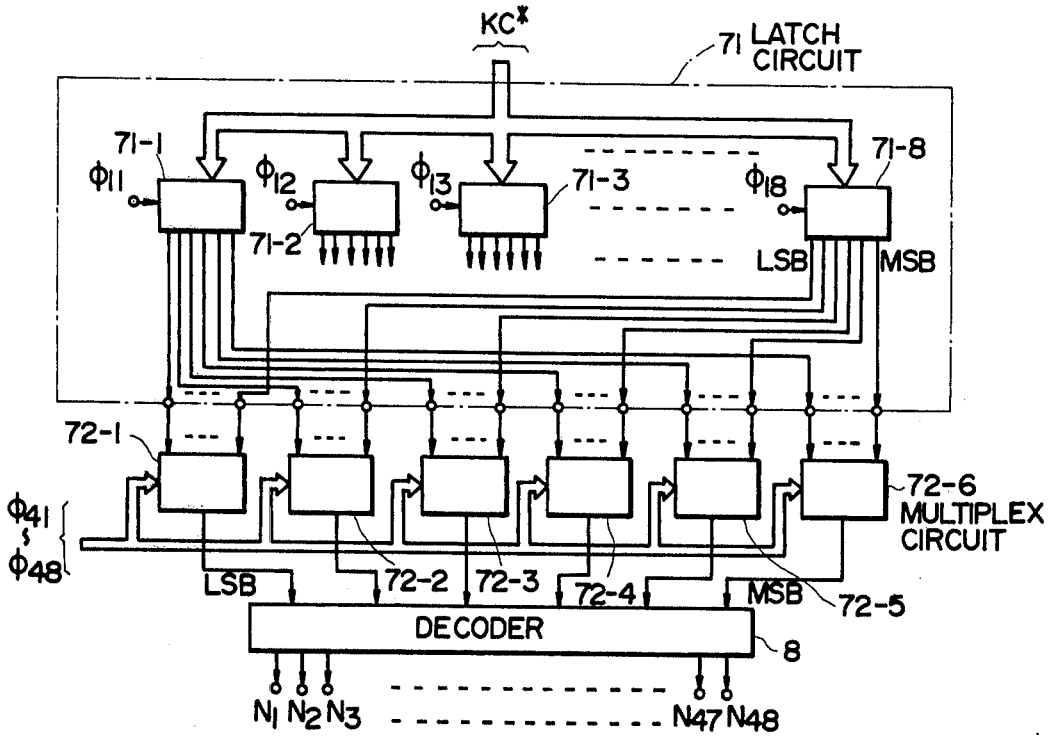
FIG. 7 is a block diagram showing the latch circuit 71 and the multiplex circuit 76 shown in FIG. 6 in detail.

FIG. 7 is a block diagram showing one actual example of the synchronizing circuit 7. The latch circuit 71 has latch circuit portions 71 - 1 through 71 - 8 corresponding to the respective channels. The key codes KC* of the respective channels produced in time-shared sequence and at a high rate from the shift register 64 (FIG. 6) are applied to data input terminals of the latch circuit 71-1 through 71-8. The first to eight high channel synchronize clocks $\phi_{11} - \phi_{18}$ provided from the decoder $D_1$ (FIG. 4) are applied to sample pulse input terminals of corresponding latch circuits 71-1 through 71-8. The key codes KC* for the respective channels applied in time shared-sequence to the latch circuits 71-1 through 71-8 are latched by each corresponding channel by the synchronize clocks $\phi_{11} - \phi_{18}$ and each of 6-bit key codes for the respective channels is provided in parallel form. Although the output key code of the latch circuits 71-1 through 71-8 is rewritten every one high key time because the synchronize clocks $\phi_{11} - \phi_{18}$ are generated at an interval of one high key time, the key code is substantially not rewritten if the same key code continues to be applied. Thus the key codes for the respective channels are converted from time-shared data to static data.

Each of six bits from the least significant bit LSB to the most significant bit MSB of the key code outputs of the latch circuits 71-1 to 71-8 is applied to a corresponding one of multiplex circuits 72-1 through 72-6. The least significant bit LSB of the key code for each channel (the output of each of the latch circuits) is applied to the multiplex circuits 72-1, the bit next to LSB to the multiplex circuit 72-2 . . . and the most significant bit MSB to the multiplex circuit 72-6, respectively. The first to the eight low channel synchronizing clocks $\phi_{41}$ to $\phi_{48}$ from the decoder $D_4$ are applied to the multiplex circuits 72-1 to 72-6. Accordingly, bit signals of only a channel corresponding to the applied clock are respectifly selected in the multiplex circuits 72-1 to 72-6 in response to the synchronizing clocks $\phi_{41}$ to $\phi_{48}$. The six outputs selected in the multiplex circuits 72-1 to 72-6 form a 6-bit key code. Thus the key codes for the respective channels are multiplexed again in a time-sharing manner in the multiplex circuits 72-1 to 72-6 in accordance with the low channel syncronizing clock $\phi_4$ applied at a low rate. Accordingly, the rate of time-sharing is changed from the high rate determined by the high channel clock $\phi_1$ to the low rate determined by the low channel clock $\phi_4$. The key codes for the respective channels multiplexed in time-sharing at the low rate are thereafter applied to a decoder 8. The decoder 8 produces in time-shared sequence the key gate control signals $N_1 - N_{48}$ having a width of one low channel time by each channel in accordance with the contents of the key code.

These key gate control signals $N - N_{48}$ are respectively applied to key gate circuits $KG_1$ to $KG_{48}$ (FIG. 1) provided for sampling the note voltages. By this arrangement, note voltages corresponding to the depressed keys are sampled in time-sharing manner and a plurality of musical tones are reproduced from these sampled note voltages.

Figure 8:
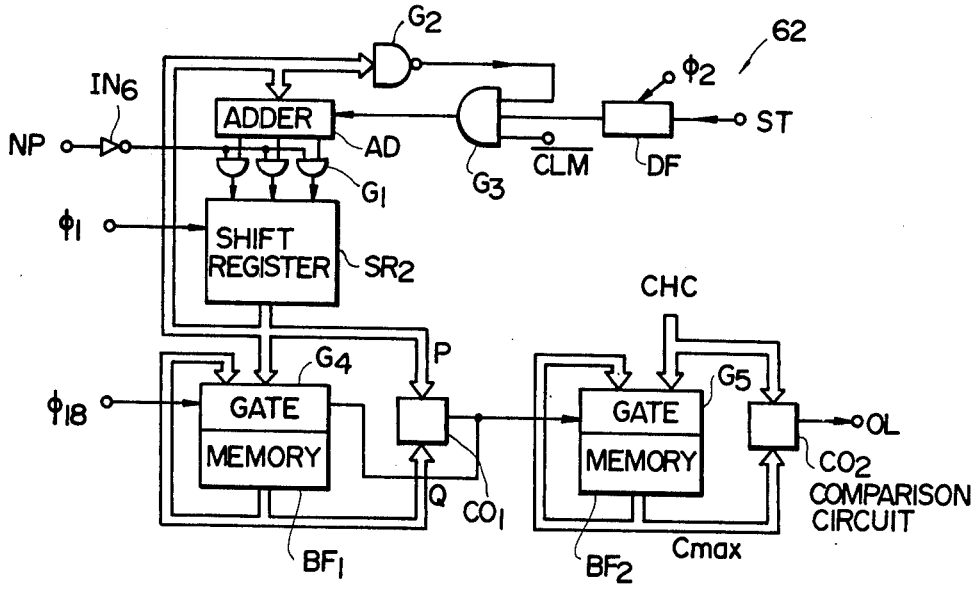
FIG. 8 is a block diagram showing an actual example of the old signal generator 62 shown in FIG. 6.

FIG. 8 is a block diagram showing one actual example of the old signal generator 62. If there is a decaying tone or tones (a channel or channels in which the key has been released) among the eight channels, the old signal generator detects a tone (channel) of which the decay has advanced further than any other tones and generates the old signal OL for causing a tone of a newly depressed key to be reproduced in this channel. A cumulative counter is composed of a circulating shift register $SR_2$ of 8 words (1 word = 3 bits) which stores counted values by each channel and is sequentially shifted by the channel clock $\phi_1$, and adder AD which adds a carry input from an AND circuit $G_3$ to the 3-bit stored counted value from the shift register $SR_2$ and a gate circuit $G_1$ which controls application of the results of addition in the adder AD to the shift register $SR_2$. If there is a channel in which the key has been released, a number of keys released after the release of the key in this particular channel is counted regardless of a key name and a channel. In the plurality of channels in which the key has been released, the above described counting is conducted for each of these channels. This counting is conducted only if (1) the key has been released in the channel and (2) the counting has not amounted to the maximum value. These conditions are detected by the AND circuit $G_3$ and the stop signal ST is applied to the carry input terminal of the adder AD for counting of the number of the released keys.

It will be understood that the above described condition (1) is satisfied when the inverted claim signal CLM is 1 and the condition (2) is satisfied when the output of the NAND circuit $G_2$ is 1. Since the maximum number of tones to be reproduced simultaneously is eight in the present embodiment, the number of keys which are released subsequent to the release of the key in a particular channel is at most eight including the key of the particular channel. The count therefore can be composed of 4 bits. A NAND circuit $G_2$ detects the maximum count 111 and thereupon disenables the AND circuit $G_3$ for stopping the counting and causing the shift register $SR_2$ to hold this maximum count 111 in the corresponding channel. The stop signal ST provided from the AND circuit $AN_2$ (FIG. 6) is delayed in a delay circuit DF by one key clock time by the clock $\phi_2$ and thereafter is applied to the AND circuit $G_3$. The delay circuit DF is provided for enabling the release of the key in the particular channel itself to be counted in the same channel because the inverted claim signal CLM is delayed one key time from generation of the stop signal ST. The new press signal NP is applied to the gate circuit $G_1$ through an inverter $IN_6$. When the new press signal NP is generated in a certain channel, the counted value in this channel of the shift register $SR_2$ is reset to zero.

If the keys are depressed in all the channels, the counted value of the shift register $SR_2$ is zero. If then the key of the first channel is released, the inverted claim signal CLM of the first channel becomes 1. If the key of the third channel is then released, the inverted claim signals CLM of the first and the third channels are respectively 1 during generation of the stop signal ST for one key time. The numbers of the released keys are respectively counted in the first and third channels, the count in the first channel becoming 2 and the count in the third channel becoming 1. As some time elapses after all of the keys have been released, counted values of 1 - 6 are stored in six channels among the eight channels, whereas the counted values of the first and the third channels become 7 (111).

Change in the counted values in the respective channels in a case where, for example, the keys are released in the order of the first, third, second, eight, fourth, fifth, sixth and seventh channels is illustrated in the following table. In this case, it is assumed that the counted value of the first channel is rest at the key time 9.

Table

| key time lapse of time | channel 1st | 2nd | 3rd | 4th | 5th | 6th | 7th | 8th |
|---|---|---|---|---|---|---|---|---|
| 1 | 1 | 0 | 0 | 0 | 0 | 0 | 0 | 0 |

Table-continued

| key time lapse of time | channel 1st | 2nd | 3rd | 4th | 5th | 6th | 7th | 8th |
|---|---|---|---|---|---|---|---|---|
| 2 | 2 | 0 | 1 | 0 | 0 | 0 | 0 | 0 |
| 3 | 3 | 1 | 2 | 0 | 0 | 0 | 0 | 0 |
| 4 | 4 | 2 | 3 | 0 | 0 | 0 | 0 | 1 |
| 5 | 5 | 3 | 4 | 1 | 0 | 0 | 0 | 2 |
| 6 | 6 | 4 | 5 | 2 | 1 | 0 | 0 | 3 |
| 7 | 7 | 5 | 6 | 3 | 2 | 1 | 0 | 4 |
| 8 | 7 | 6 | 7 | 4 | 3 | 2 | 1 | 5 |
| 9 | 0 | 6 | 7 | 4 | 3 | 2 | 1 | 5 |
| . | . | . | . | . | . | . | . | . |
| . | . | . | . | . | . | . | . | . |
| . | . | . | . | . | . | . | . | . |
| . | . | . | . | . | . | . | . | . |
| . | . | . | . | . | . | . | . | . |

In the foregoing manner, the number of keys released after the release of the key in a particular channel is counted for each channel in which the key has been released and the tone of the channel in which the count is the greatest is regarded to have most advanced in decay.

Comparison of the respective counted values is made in a comparison circuit $CO_1$. The largest counted value Q up to the present is circulatingly stored in a buffer memory $BF_1$. This stored largest counted value Q is compared in the comparison circuit $CO_1$ with a counted values P of the repective channels provided in time-shared sequence according to the clock $\phi_1$, and a signal 1 is produced from this comparison circuit $CO_1$ if $P > Q$. A gate circuit $G_4$ selects a counted value from the shift register $SR_2$ by this signal 1, supplying a larger counted value to the buffer memory $BF_1$ and rewriting the stored largest counted value Q. If no new counted value is selected by the gate circuit $G_4$, the stored counted value continues to circulate in the buffer memory $BF_1$ and remains stored therein.

The output signal 1 from the comparison circuit $CO_1$ is also applied to a gate circuit $G_5$ for selecting a channel code CHC in accordance with the high channel synchronizing clock $\phi_{11} - \phi_{18}$. This channel code CHC is stored in a buffer memory $BF_2$ simultaneously with application of a new counted value to the memory $BF_1$. Accordingly, a channel code representing a channel corresponding to the largest counted value stored in the memory $BF_1$ is stored in the memory $BF_2$. The channel code Cmax stored in the memory $BF_2$ is held in circulation in the memory $BF_2$ unless the stored counted value in the memory $BF_1$ is rewritten.

A comparison circuit $CO_2$ compares the channel codes CHC of the respective channels sequentially produced in response to the clock $\phi_1$ with the stored channel code Cmax and produces a signal 1 when the contents of the two codes coincide with each other. This output signal 1 is the old signal OL which is produced in a time slot corresponding to the channel in which the counted value is the greatest. The old signal OL is produced in only one channel in one key time. Reproduction of a musical tone in the channel is stopped by the old signal OL (if a decaying tone has been produced due to decay control after the release of the key) and the musical tone of the newly depressed key is reproduced in this channel.

According to the above table, the old signal OL is produced in the first channel during the key time 1 - 7. In the key time 8, the first and the third channels have the largest counted value of 7. However, the counted value of 7 in the first channel has previously been stored in the buffer memory $BF_1$ and the two inputs in the comparison circuit $CO_1$ does not satisfy the condition of $P > Q$ when the counted value of 7 in the third channel is produced from the shift register $SR_2$. Accordingly, no signal 1 is produced and the channel code Cmax stored in the buffer memory $BF_2$ remains unchanged. Therefore, the old signal OL is still produced in the time slot corresponding to the first channel even in the key time 8. If a new key is depressed and the new press signal NP is produced in the first channel, the count is reset in the first channel as shown in the key time 9 in the above table. In the key time 9, the old signal OL is produced in the third channel.

For clearing the maximum count in the buffer memory $BF_1$ every one key time, an eight channel synchronizing signal $\phi_{18}$ is applied to a gate circuit $G_4$. The eight channel synchronizing signal $\phi_{18}$ has the same pulse interval as the key clock $\phi_2$, i.e. one key time and is produced one channel time before the rise of the key clock $\phi_2$. As a result, when the count in the eight channel is provided from the shift register $SR_2$ and is compared in the comparison circuit $CO_1$, the stored maximum count is reset to zero irrespective of the result of comparison. Alternatively stated, the stored maximum count Q which is used as the reference for comparison is reset to zero when comparison with respect to all of the eight channels has been completed and a new cycle of comparison proceeds in a next key time. The arrangement is necessitated because otherwise the maximum count of 7 would always be stored regardless of the respective counts in the shift register $SR_2$.

What is claimed is:

1. An electronic musical instrument comprising:

a voltage circuit for producing a plurality of d-c note voltages corresponding to respective keys;

a plurality of key gate circuits connected at inputs thereof to the outputs of said voltage circuit and connected at outputs thereof in common connection;

a key gate control signal generator for generating a key gate control signal used for enabling, in response to depression of a key, one of said key gate circuits corresponding to the depressed key;

a plurality of channel gate circuits connected to the common output terminal of said key gate circuits;

channel gate signal generation means for producing, in time-shared sequence, channel gate signals used for enabling said channel gate circuits;

storage means for separately storing each of the d-c note voltages supplied from said channel gate circuits; and a plurality of musical tone generation systems for producing musical tone signals corresponding to the stored d-c note voltages.

2. An electronic musical instrument as defined in claim 1 wherein said key gate control signal generator comprises:

key data generation means having a scanner which scans all key switches at a first scanning rate and generating key data represented by a pulse appearing in a time slot corresponding to a key switch which is ON in one scanning period;

key code generation means for producing key codes corresponding to the respective key switches in synchronization with said scanning rate;

a key code memory having a plurality of channels respectively capable of storing key codes and delivering the stored key codes in time-shard sequence in synchronization with said scanning rate;

storage control means for causing a key code from said key code generation means corresponding to the key switch which is ON to be stored in any one of the channels of said key code memory in accordance with said key data; and a circuit for generating a key gate control signal corresponding to the key code delivered from said key code memory.

3. An electronic musical instrument as defined in claim 2 wherein said circuit for generating a key gate control signal comprises:

holding means for holding the key codes produced from said key code memory by each channel;

time-shared multiplexing means for sequentially selecting the codes held in said holding means in response to a clock produced at a second rate which is lower than said first scanning rate; and means for decoding the key code multiplexed in time-sharing to obtain the key gate control signal.

4. An electronic musical instrument as defined in claim 2 further comprising:

delay means for delaying the key data produced from said key data generator by one scanning period;

detection means including a comparison circuit which compares the key data with the delayed key data and detecting a newly depressed key and a newly released key;

a depressed key memory including channels of the same number as a maximum number of tones to be reproduced simultaneously and storing information as to whether a key is depressed or not in the respect channels;

means for causing the key code of the switch which is ON to be stored in any one of the channels of said key code memory in which the key has been released upon detection of a newly depressed key in response to contents of storage in said depressed key memory;

means for causing said depressed key memory to store the depression of the key in its corresponding channel simultaneously with the storage of the key code in said key code memory; and means for clearing the storage of the depressed key in the channel of said depressed key memory corresponding to the released key upon detection of the release of the key.

5. An electronic musical instrument as defined in claim 2 further comprising:

means for identifying the channel in which the key has been released;

means for counting, with respect to each individual channel in which the key has been released, the number of keys released after the release of the key in such individual channel upon detection of the released key and the channel in which the key has been released;

means for comparing the counted values of the respective channels and providing an old signal representing the channel in which the counted value is the greatest; and means for causing said key code to be stored in the channel of said key code memory corresponding to the produced old signal.

* * * * *